US007419457B1

(12) United States Patent
Sudeith et al.

(10) Patent No.: US 7,419,457 B1
(45) Date of Patent: Sep. 2, 2008

(54) CLIMBING WALL ASSEMBLY

(75) Inventors: Timothy S. Sudeith, Edina, MN (US); Keith Anderson, Minneapolis, MN (US); Kris Johnson, Mukwonago, WI (US); Jeremy Mariette, Crystal, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 354 days.

(21) Appl. No.: 11/230,353

(22) Filed: Sep. 19, 2005

Related U.S. Application Data

(60) Provisional application No. 60/611,105, filed on Sep. 17, 2004.

(51) Int. Cl.
*A63B 9/00* (2006.01)

(52) U.S. Cl. ..... 482/37; 482/35

(58) Field of Classification Search ..... 482/35–37, 482/904, 23; 434/247
See application file for complete search history.

(56) References Cited

U.S. PATENT DOCUMENTS

| | | | | |
|---|---|---|---|---|
| 5,254,058 | A | 10/1993 | Savigny | |
| 5,732,954 | A * | 3/1998 | Strickler et al. | 273/441 |
| 5,941,041 | A * | 8/1999 | Robinson et al. | 52/591.4 |
| 5,944,634 | A * | 8/1999 | Neves | 482/37 |
| 6,074,327 | A | 6/2000 | Franklin | |
| 6,083,142 | A | 7/2000 | Wilson | |
| 6,231,482 | B1 | 5/2001 | Thompson | |
| 2002/0019297 | A1 * | 2/2002 | Vettori | 482/37 |
| 2005/0245355 | A1 * | 11/2005 | Brewer et al. | 482/37 |
| 2006/0116244 | A1 * | 6/2006 | Postma et al. | 482/37 |

* cited by examiner

*Primary Examiner*—Fenn C Mathew
(74) *Attorney, Agent, or Firm*—Anthony G. Eggink; Katrina M. Eggink

(57) ABSTRACT

A climbing wall assembly having wall panels to form free-standing, wall-mounted or a combination climbing wall assembly. The climbing wall assembly further has novel handhold structures constructed to be used with removable elements to form a challenge course.

20 Claims, 3 Drawing Sheets

CLIMBING WALL ASSEMBLY

This Application claims the benefit of U.S. Provisional Patent Application Ser. No. 60/611,105, filed on Sep. 17, 2004.

BACKGROUND OF THE INVENTION

The present invention relates generally to climbing wall assemblies. Particularly, the invention relates to climbing wall assemblies utilizing cooperating structures and devices, including fixed and freestanding climbing wall structures, to form challenge climbing courses using novel hand hold structures, flexible noodle-like members, magnetic flag pegs and wall panel bolt covers.

Artificial climbing and bouldering walls are increasingly used due to physical fitness awareness and interest in climbing and bouldering sports. Climbing wall assemblies are also being provided to introduce children to the climbing sports in a safe, convenient and educational manner. Various devices have also been introduced to make climbing for children a fun and educational experience. Exemplary climbing wall assemblies and devices are disclosed in Applicant's pending U.S. patent application having Ser. No. 10/236,728, filed on Sep. 6, 2002, and in the patent application entitled Safety Mat Securement Assembly having Ser. No. 60/545,543 filed on Feb. 18, 2004, the teachings of both being fully incorporated by reference herein.

It is desirable to provide climbing wall assemblies in various indoor and outdoor locations, for example in a gym, a playground area, a classroom, etc. It is further desirable to provide a moveable climbing wall assembly or movable portions of a climbing wall assembly which are easily assembled, disassembled and then removed and stored or transported, particularly when space is limited. The freestanding climbing wall assembly of the present invention provides a climbing wall structure that may be quickly assembled in a plurality of arrangements including a totally freestanding climbing wall structure to allow climbing completely around the structure. The wall assemblies are constructed and arranged to be easily assembled, disassembled, transported or stored.

It is also desirable to incorporate the ability to create an obstacle-type courses on a climbing wall, to thereby make climbing fin and challenging to the users. The obstacle or challenge course of the present invention provides novel hand hold structures and cooperating elongated polymeric or foam noodle members so that students may climb under, over, around and/or through the noodle members extending from and between the hand holds.

It is also desirable to allow climbers, particularly young climbers, to play games and participate in initiative tasks on the climbing wall. Magnetic flag pegs are provided to be used in cooperation with the wall assemblies of the present invention so that such games and tasks may be executed by young climbers through placing, moving, grabbing and tossing the various magnetic flag pegs.

It is also desirable to provide an aesthetically pleasing climbing wall structure. Bolt covers are provided by the invention to cover the bolts or fastener used to secure the climbing wall panels. For example, recessed and non-recessed bolts are provided to secure and mount climbing wall panels to an existing wall or other substructure. Panel bolt covers of the present invention are provided to match the panel surface and to give the climbing wall a uniform look.

SUMMARY OF THE INVENTION

The climbing wall assembly of the invention comprises freestanding climbing wall structures utilized in a challenge course having novel hand holds which receive elongated flexible noodle members and magnetic flag pegs, as well as panel bolt covers.

The freestanding climbing wall assemblies of the present invention allow climbers to climb around climbing wall structures. The wall panels are constructed and arranged to be mounted entirely, or in portions, onto a wall, for example. The climbing wall panels are preferably peripherally framed in aluminum, steel or a like material to increase strength and durability. The panels are preferably joined together using a lift-off hinge assembly, which permits a "360° wall", for example, to be easily set up, taken down, transported and stored. Further, the standing wall panels may be further secured by brace members, constructed of steel or other strong rigid materials, for example.

The challenge course of the present invention includes novel hand hold structures adapted to receive elongated, tubular structures or flexible noodles, made of polystyrene foam or like material. The hand hold structures have bores to receive and secure the ends of the tubular structures to form loop configurations extending from the hand holds structures of the climbing wall. The hand holds are constructed and arranged having at least one apertured grip member which pinch or hold the end of the noodle structure securely in place. Positioning noodles into the apertures of the holds enables educators to create obstacle courses and other challenges protruding from the climbing wall. Students may climb under, over, around and/or through the noodle structures.

The novel hand hold structures of the challenge course may have various embodiments, having various shapes and numbers of bores or apertures to receive the noodle structure ends. For example, protrusions extending into the apertures of the hand hold body may be provided to secure the noodle structures by compressing the flexible noodle body. The number and position of the holes in the hand holds allows for a variety of configuration possibilities utilizing the noodle members. By changing the location of the hand holds on the climbing wall, the path shape of the noodle obstacle course may be changed. The challenge course hand hold structures may be used as regular hand holds on a climbing wall when not being utilized as part of the challenge course.

Magnetic flag peg structures are provided and designed to be used in cooperation with other elements of the invention. Games and initiative tasks on the climbing wall may be provided by placing, moving, grabbing and tossing the various magnetic flag pegs. The magnetic pegs have elongated, generally cylindrical bodies with flags attached at one end. A magnetic element is positioned within the peg body at the opposite end. An eye bolt and grommet may be used to attach the flag to the peg body, however, other attachment means may be used. The magnetic pegs are designed to attach within the bolt hole of a hand hold structure or to the surface of a magnetic climbing wall or wall plate structure, for example. The flags and the peg bodies may be constructed of multiple colors and may have printed matter such as letters, words, numbers and symbols.

Panel bolt covers of the present invention may be used to cover the bolts or other fasteners that hold climbing wall panels to the substructure upon which the panels are mounted. For example, the bolt covers have bodies which are structured to cover recessed and non-recessed bolts. Bolt covers may be constructed of a polymeric or plastic composition and held in place using wood screws or like fasteners. For example, the covers may be glued in place. The covers may be provided in a variety of colors and have various surfaces.

It is a benefit of the present invention to provide a climbing wall assembly which may be utilized in various locations, for example in a gym, outside, in a classroom, etc. It is another benefit of the present invention to provide a climbing wall assembly which is easily set up, removed, store and transported. It is a further benefit of the present invention to incorporate create obstacle-type courses on a climbing wall, to make climbing fun and to challenge the users and to play games and engage in initiative tasks on the climbing wall. It is also a benefit of the present invention to provide aesthetically pleasing covers for the bolts or fastener used to secure the climbing wall panels.

These and other benefits of this invention will become clear from the following description by reference to the drawings.

DESCRIPTION OF THE PREFERRED EMBODIMENTS

The climbing wall assembly of the present invention relates to a plurality of climbing wall panels constructed and arranged to form free-standing climbing wall structures and free-standing wall-portions to be connected to wall-mounted climbing wall panels. A challenge course may be created using the climbing wall panels in cooperation with novel hand hold structures constructed and arranged to receive magnetic members having flags and elongated flexible members. Bolt covers are further utilized to cover fasteners used to attach panel members to substructures, such as existing walls.

Figure 1:
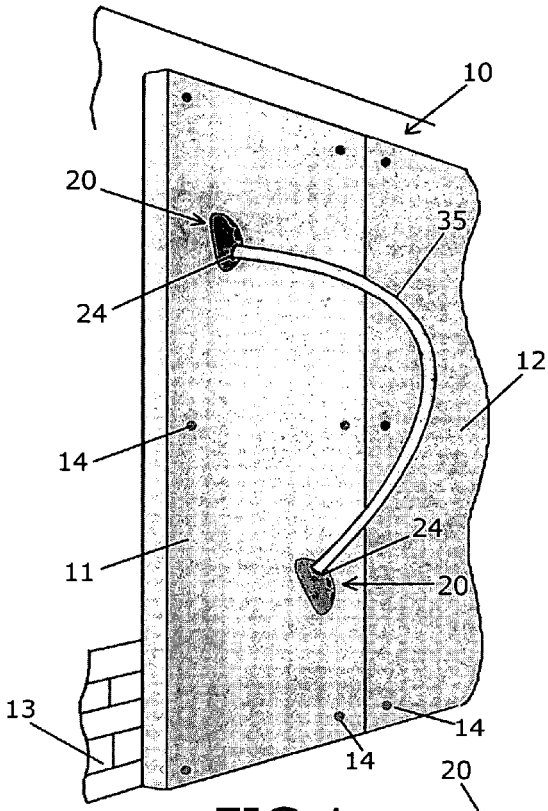
FIG. 1 is a perspective view showing the climbing wall assembly with the challenge course of the present invention.
Figure 2:
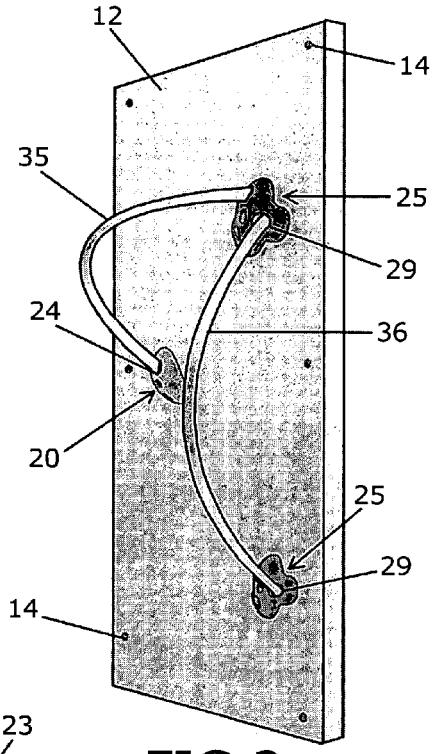
FIG. 2 is another perspective view showing the climbing wall challenge course of the present invention and showing the handhold structures and cooperating noodle members.
Figure 3:
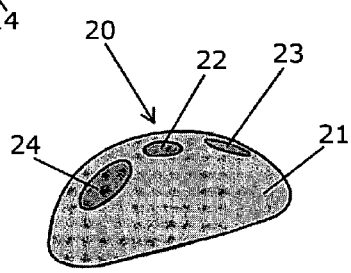
FIG. 3 is a perspective view of a handhold structure of the challenge course of the present invention.
Figure 4:
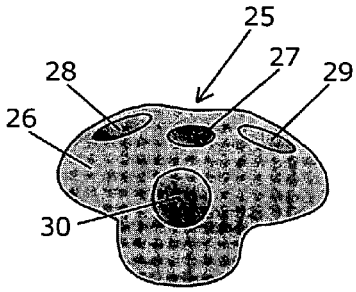
FIG. 4 is a perspective view of another handhold member of the challenge course of the present invention.

Referring to FIGS. 1-5, the climbing wall assembly 10 is shown in FIG. 1 and other elements comprising a climbing challenge course are shown in FIGS. 2-5. Adjacent climbing wall panels 11 and 12 are secured to support wall 13 using fasteners 14. The challenge course on climbing wall assembly 10 is shown comprising elongated flexible or noodle members 35 and 36 and cooperating hand hold structures 20 and 25. The noodle members are preferably constructed of a flexible elongated cylindrical material, such as polystyrene or a soft polymeric foam-like material. The challenge course assembly permits a climbing wall to be utilized as an obstacle course, for example. As shown in FIGS. 3 and 4, the novel hand hold structures 20 and 25 have unitary body members 21 and 26, respectively, which include bores 23-24 and 28-30, respectively, which are constructed and arranged to receive the ends of the elongated noodle members 35 or 36. Body members 21 and 26, i.e. constructed of a molded polyurethane or the like, have apertures 22 and 27, respectively, through which a fastener may extend to secure the hand hold to the wall panel.

Figure 5:
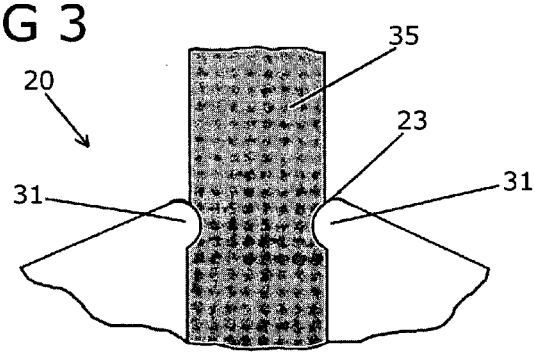
FIG. 5 is an enlarged sectional view of a handhold member having a noodle member therein.

As shown particularly in FIG. 5, the bores or holes 23-24 and 28-30 of the hand holds 20 and 25 are constructed and arranged with internal protrusions or grip members 31 to hold the ends of noodle members 35 and 36 securely in place by compressing the noodle member ends. The number of holes in the hand holds and the shape of the hand hold may vary. For example, hand hold 20 is shown having two bores or apertures 23 and 24 while hand hold 21 is shown having three such bores or aperture members 28-30. The number and position of the holes in the hand holds are exemplary and allows for a variety of handhold body configurations to use the noodle members. By changing the location of the hand holds on the climbing wall and by switching the secured ends into various hand hold apertures the shape of the noodle obstacle course can be easily altered. These hand holds may be used as regular hand holds when not being utilized as part of the challenge course.

Figure 6:
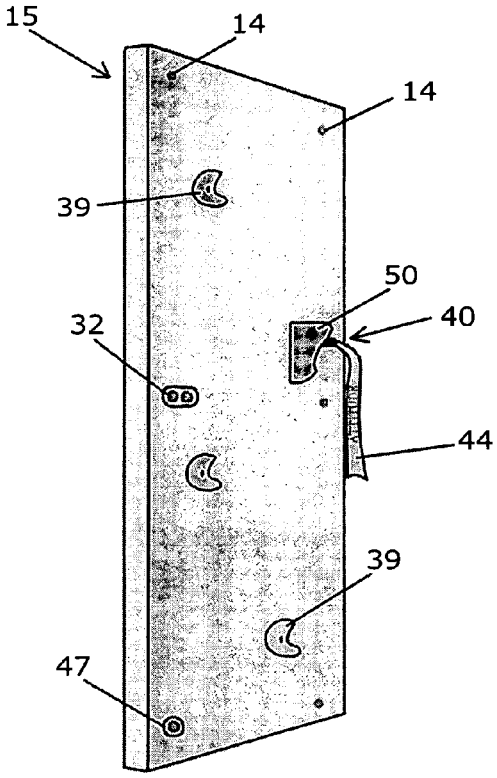
FIG. 6 is a perspective view of the wall assembly having a magnetic flag peg member of the present invention.
Figure 7:
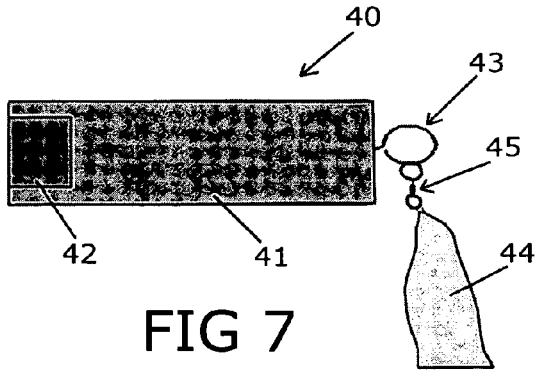
FIG. 7 is a sectional view of the magnetic flag peg of the present invention.
Figure 8:
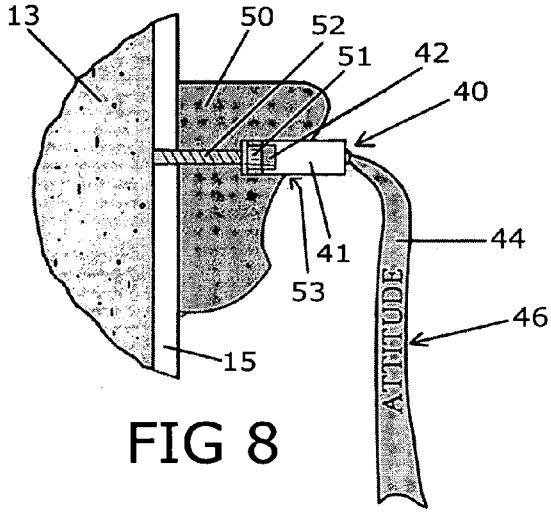
FIG. 8 is a sectional view of the magnetic flag peg of the present invention positioned in a handhold structure.

Referring to FIGS. 6-8, wall panel 15 is shown having fastemers 14 which may be utilized to secure the wall panel to a substructure, for example wall 13. Handholds 39 are shown mounted to wall panel 15 and bolt covers 32 and 47, which are further discussed below, are shown covering fasteners 14. Further, handhold 50 is shown in use with magnetic flag peg 40 and secured to wall panel 15 using a bolt having head 51 and shaft 52. FIG. 7 shows magnetic flag peg 40 comprising a generally cylindrical peg body 41 having a magnet member 42 located at one end of the body and a flag 44 attached to the other end. Flag 44 is shown being attached to peg body 41 using attachment ring 43 and flag connector structure 45. Preferably, an eye bolt and grommet may be used to attach the flag to the peg, however, other attachment means may be used. As shown in FIG. 8, magnetic flag pegs 40 are constructed and arranged to be positioned within the interior of the bolt hole 53 or, for example, aperture 22 of the handhold of FIG. 3, of a hand hold by the magnetic force between the magnet 42 and the metallic bolt head 51. The flag pegs 40 may also be secured to other metallic or magnetic portions of a climbing wall on magnetic climbing wall structures or other metallic or magnetic components, such as wall plates. The flags 44 and the peg bodies 41 on which they are attached may be provided in multiple colors. The flag portions 44 may have printed letters, words, numbers and symbols, for various educational and recreational purposes. For example, FIG. 8 shows a flag 44 with printing 46 (the word 'attitude'). The magnetic flag pegs 40 make it possible for a climber to play games and to engage in initiative tasks on the climbing wall by placing, moving, grabbing, collecting and/or tossing various magnetic flags.

Figure 9:
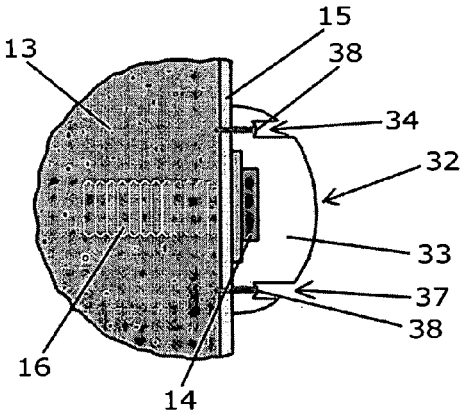
FIG. 9 is a sectional view of a panel bolt cover embodiment of the present invention.
Figure 10:
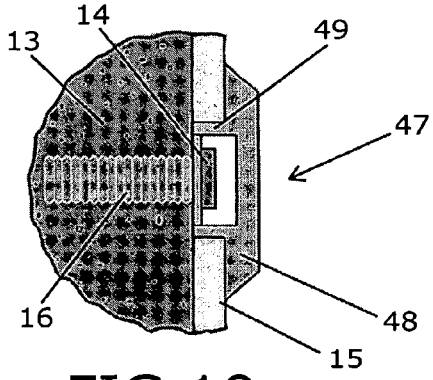
FIG. 10 is a sectional view of another panel bolt cover embodiment of the present invention.

Referring to FIGS. 9 and 10, bolt covers 32 and 47 are shown covering fasteners or bolts 14. Fasteners 14 having shafts 16 are used to secure climbing wall panel 15 to the substructure, i.e., wall 13, as well as adjoining panels to form a climbing wall assembly 10, for example. A wall panel 15 (i.e., 4×8 ft.) may utilize six bolts 14, for example. The bolt covers 32 and 47 are shown having generally circular or oval bodies 33 and 48, respectively, designed to protect climbers from snagging articles of clothing, for example, on protruding bolt parts, i.e., bolt heads. Other bolt cover body shapes may also be utilized. The bolt covers 47 and 32 are constructed and arranged to cover recessed and non-recessed bolts, respectively. FIG. 9 shows bolt cover 32 covering non-recessed bolt 14 and FIG. 10 shows bolt cover 47 covering recessed bolt 14. Recessed bolt cover 47 is shown being frictionally held in place using protruding portion 49 of body 48 in the recessed portion of the wall panel 15, while the non-recessed bolt cover 32 is shown being held in place by securement members 38 (i.e., nails, screws and the like) extending through apertures 34 and 37 into wall panel 15.

The bolt covers are preferably aesthetically pleasing, provided in various colors and have various exterior surfaces, to match the wall panel surface and to provide a uniform wall panel look. The bolt covers may be constructed of a plastic or like material and may be secured in place using a frictional fit, by threading into an internally threaded aperture, using wood screws, adhesive, pins or other magnetic, chemical or mechanical fastening means known in the art.

Figure 11:
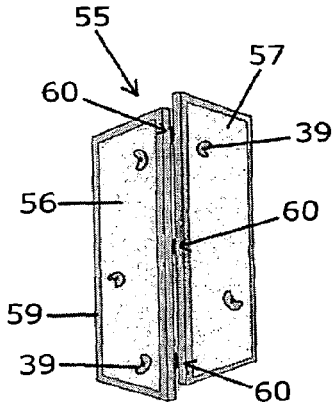
FIG. 11 is a perspective view showing wall panels forming a climbing wall structure of the present invention.
Figure 12:
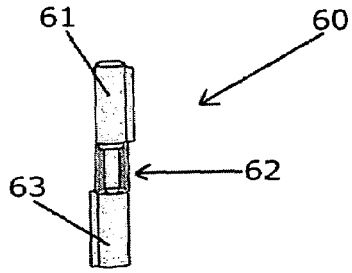
FIG. 12 is a perspective view of the pivotable attachment means used to connect the wall panels of FIG. 11.
Figure 13:
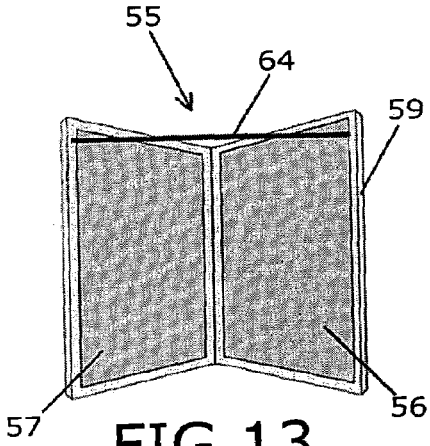
FIG. 13 is a perspective view of wall panels forming a free-standing climbing wall structure of the present invention
Figure 14:
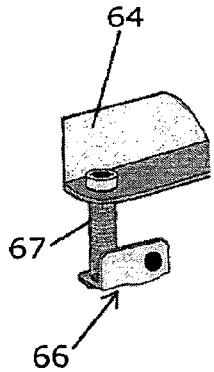
FIG. 14 is a perspective view of the connection and bracing structure used to construct the assembly of FIG. 13.
Figure 15:
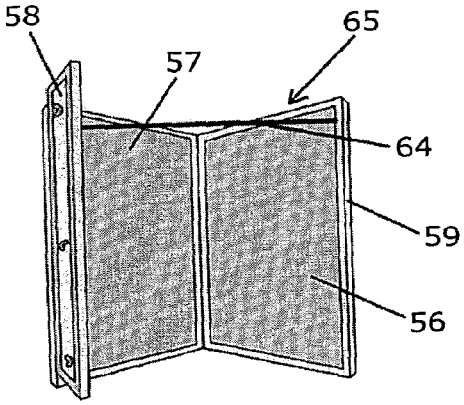
FIG. 15 is a perspective view of wall panels forming another climbing wall structure of the present invention.

Referring to FIGS. 11-16, various climbing wall assemblies, i.e., 55 and 65, are shown. FIGS. 11 and 13 show two adjacent panel members 56 and 57 being linked or joined together using a plurality (i.e., three) of connecting structures 60 and forming a two-panel wall structure 55. FIG. 15 shows three panel members 56-58 joined together to form three-panel wall structure 65. Handhold members, for example, hand hold members 20 and 39, are shown mounted to wall panels 56-58. The panel members may have exterior channels 59, i.e., framing of aluminum, steel or the like. The exterior channel portions 59 may be bolted or welded together and fastened about the wall panel periphery. Connecting structures 60, i.e., lift off hinge members, are shown comprising upstanding hinge pin members 62 and cooperating sleeve members 61 and 63, as shown in FIG. 12, and wherein cooperating portions of the hinge are secured to adjacent wall panels or peripheral exterior channels. Brace member 64 is shown in FIG. 13 to secure wall panels 56 and 57 at a specified angle with respect to each other. The brace member 64 is shown to extend between the end wall panels 56 and 57 to form and secure the climbing wall assembly 55. Brace member 64 is secured to wall panels 56 and 57 using attachment structure 66 and pin 67, shown in FIG. 14. Pin member 67 is shown extending from angle brace 64 for insertion into an aperture of brace attachment 66. This structure allows for easy set up and dismantling of climbing wall assembly 55.

Figure 16:
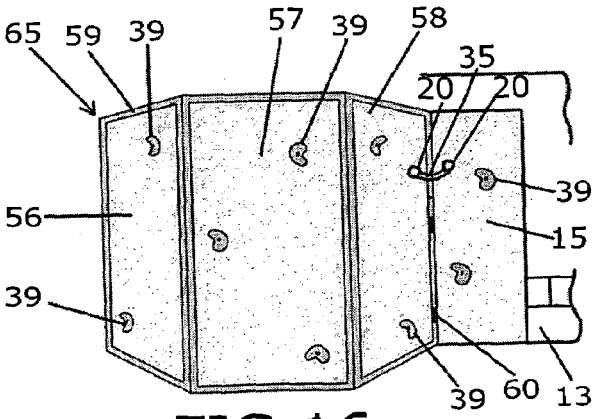
FIG. 16 is a perspective view of yet another climbing wall assembly of the present invention.

FIG. 15 shows a three-panel free standing wall structure 65. Wall panel 58 is shown joined to wall panel 57 and brace member 64 is shown to stabilize the structure. Other brace members may be provided to secure the three wall panel structure. FIG. 16 shows the free-standing climbing wall structure 65 attached to a wall-mounted climbing wall panel 15 using connecting structures 60, whereby climbing panels 56-58 extend outwardly from the wall 13. Wall panel 15 is mounted or secured onto wall 13, as discussed above. The fixed wall panel structure 15 has a cooperating attachment structure for receiving and securing wall panel 58, i.e., a rigid channel member containing cooperating lift-off hinge parts. Handholds 20 are shown mounted on both wall panels 58 and 15 and receiving opposing ends of noodle structure 35. In this way, wall structure 65 and noodle members 35 and 36 may be incorporated with a wall-mounted climbing wall panel to form a challenging climbing route path.

Alternatively, to form a six-sided free-standing wall structure, for example, three additional wall panels may be joined together and secured and braced with respect to the three-panel wall structure 65 of FIG. 15. Free standing wall structures having any number of sides may be formed using various angle braces and panel mounting means as discussed herein. The free-standing climbing wall structures allow climbers to climb completely around a climbing structure. As discussed above, the assembly may also be mounted entirely, or in portions, onto a wall. For example, three panels may be connected to an existing wall whereby the climbing panels extend outwardly from the wall. The climbing wall panels may preferably be framed in a rigid structure, i.e., aluminum or steel, to increase strength and durability. The use of lift-off hinge structures allow a "360° wall" to be easy to set up and take down, to transport and store. When in a usable position the climbing wall is preferably secured in place with respect to the ground.

As many changes are possible to the climbing wall assembly and related devices of this invention, utilizing the teachings thereof, the description above and the accompanying drawings should be interpreted in the illustrative and not the limited sense.

The invention claimed is:

1. A climbing wall assembly comprising:

a) at least one wall panel constructed and arranged to be joined by adjacent wall panels, at least one hand hold structure mounted to said at least one wall panel, said at least one wall panel having a plurality of apertures to provide a plurality of climbing paths, means to attach said at least one hand hold structure to said at least one wall panel, said means to attach being fixed in each said aperture;

b) each said hand hold structure having a first aperture therethrough, said first aperture being constructed and arranged to receive said means to attach said hand hold, said hand hold further having at least one second aperture having a generally cylindrical configuration with an inner peripheral protrusion; and c) a removable structure for insertion into either said first aperture or said at least one second aperture for use by a climber of said climbing assembly, said removable structure being either an elongated polymeric foam cylindrical member for insertion into said at least one second aperture and protruding substantially outward from the surface of the hand hold or a cylindrical magnetic member having a flag attached thereto for insertion into said first aperture.

2. The climbing assembly of claim 1, wherein said means to attach said handhold received in said first aperture is a metallic fastener and wherein said cylindrical magnetic member is constructed for insertion into said first aperture and being in magnetic cooperation with said metallic fastener.

3. The climbing assembly of claim 1, wherein said at least one wall panel includes means to secure said wall panels in an adjoining wall panel arrangement.

4. The climbing assembly of claim 3, wherein said means to secure said wall panels is comprised of a mounting aperture therethrough and fastening elements for extension through said mounting elements.

5. The climbing assembly of claim 3, wherein said means to secure said wall panels is comprised of cooperating channels, sleeves and hinges to form a free standing structure.

6. The climbing assembly of claim 4, wherein a bolt cover member is provided for insertion into said mounting aperture.

7. The climbing assembly of claim 6, wherein said bolt cover has a centrally disposed plug member for frictional insertion into said mounting aperture.

8. The climbing assembly of claim 6, wherein said bolt cover is a polymeric structure having means to attach to said wall panel.

9. The climbing assembly of claim 1, wherein a plurality of hand holds are provided and wherein said polymeric cylindrical member has a length and opposing ends and wherein each end of said polymeric cylindrical member is inserted into a second aperture of a different hand hold structure to form a challenge course portion.

10. A climbing wall assembly comprising:

a) a plurality of wall panels arranged in a side by side wall panel configuration;

b) a plurality of hand hold structures mounted on said wall panels to form a climbing course, each said hand hold structure having at least two bores, one said bore being constructed and arranged to receive a metallic fastener for mounting of said hand hold structure on said climbing wall; and c) at least one elongated flexible member having two ends and a length, each said end for insertion into the bores of different hand hold structures to thereby form looped obstacle for a climber to pass through.

11. The climbing wall assembly of claim 10, wherein a magnetic element having a flag member is provided for removable positioning onto said metallic fastener.

12. The climbing wall assembly of claim 10, wherein at least one said wall panel is free standing and wherein pivotable connection means are provided for arranging and connecting said at least one said pivotable wall panel in a side by side wall panel configuration.

13. The climbing wall assembly of claim 12, wherein said pivotable connection means include a plurality of hinges and brace means.

14. The climbing wall assembly of claim 10, wherein at least one said wall panel is mounted to a fixed wall and wherein means to attach are provided for arranging said at least one said fixed wall panel in a side by side wall panel configuration.

15. The climbing wall assembly of claim 14, wherein said means to attach include a fastener for insertion through one said bore and further wherein a cover member is provided for covering said fastener and said bore.

16. A climbing wall assembly comprising:

a) a plurality of generally rectangular wall panels arranged in a side by side wall panel configuration to form a continuous wall structure;

b) a plurality of hand hold structures mounted on said wall panels to form a climbing course, each said hand hold structure having at least two bores, one said bore having a metallic fastener for mounting said hand hold structure to a wall panel;

c) a magnetic member having a flag member attached thereto for removable positioning onto said metallic fastener; and d) at least one elongated flexible cylindrical member for insertion into said other bore of said hand hold structure to thereby form an obstacle for a climber.

17. The climbing wall assembly of claim 16, wherein at least one said wall panel has a plurality of apertures therethrough and wherein fasteners extend through said apertures to mount said wall panel to a fixed structure and wherein a fastener cover member is provided to cover each said fastener.

18. The climbing wall assembly of claim 17, wherein said cover member is either fastened to said wall panel or frictionally held in said apertures.

19. The climbing wall assembly of claim 16, wherein at least one said wall panel is free standing and wherein pivotable connection means are provided for connecting the wall panels in a side by side wall panel configuration.

20. The climbing wall assembly of claim 19, wherein a said plurality of wall panels are arranged in a side by side free standing wall panel configuration to form a continuous climbing course.

* * * * *